US006415465B1

(12) United States Patent
Harrow

(10) Patent No.: US 6,415,465 B1
(45) Date of Patent: Jul. 9, 2002

(54) BED FRAME WITH UNIQUE CONNECTOR AND METHOD

(76) Inventor: Lawrence M. Harrow, Hollywood Bed & Spring Mfg. Co., 5959 Corvette St., Commerce, CA (US) 90040

( * ) Notice: Subject to any disclaimer, the term of this patent is extended or adjusted under 35 U.S.C. 154(b) by 0 days.

(21) Appl. No.: 09/496,871

(22) Filed: Feb. 2, 2000

(51) Int. Cl.[7] ..... A47C 19/02; A47C 19/12
(52) U.S. Cl. ..... 5/201; 5/184
(58) Field of Search ..... 5/201, 200.1, 202, 5/282.1, 184, 286

(56) References Cited

U.S. PATENT DOCUMENTS 3,803,644 A * 4/1974 Harris ..... 5/181
3,945,064 A * 3/1976 Harris et al. ..... 5/184
5,161,268 A 11/1992 Harrow
5,920,930 A 7/1999 Harrow

* cited by examiner

*Primary Examiner*—Alexander Grosz
(74) *Attorney, Agent, or Firm*—John J. Connors; Connors & Associates, Inc

(57) ABSTRACT

A boxspring of a predetermined width is supported on bed frame including a pair of side rails attached together by at least one pair of cross bars. Each cross bar has two segments with outer ends that overlap. The outer end of one of the two segments has an inwardly extending locking element formed in this outer end, and the outer end of the other segment has a receptacle therein. With the two segments of each pair of cross bars in a overlapping and abutting relationship, the locking elements are positioned at a predetermined location to be received in their corresponding receptacles in the outer end of the opposed other segment so that the distance between the attached side rails is substantially equal to the width of the box spring. One outer end of one cross bar segment having at least one connector member extending therefrom and the other outer end to which said one segment is connected having a slot therein that receives the connector member of said one segment when the segments are connected together.

15 Claims, 4 Drawing Sheets

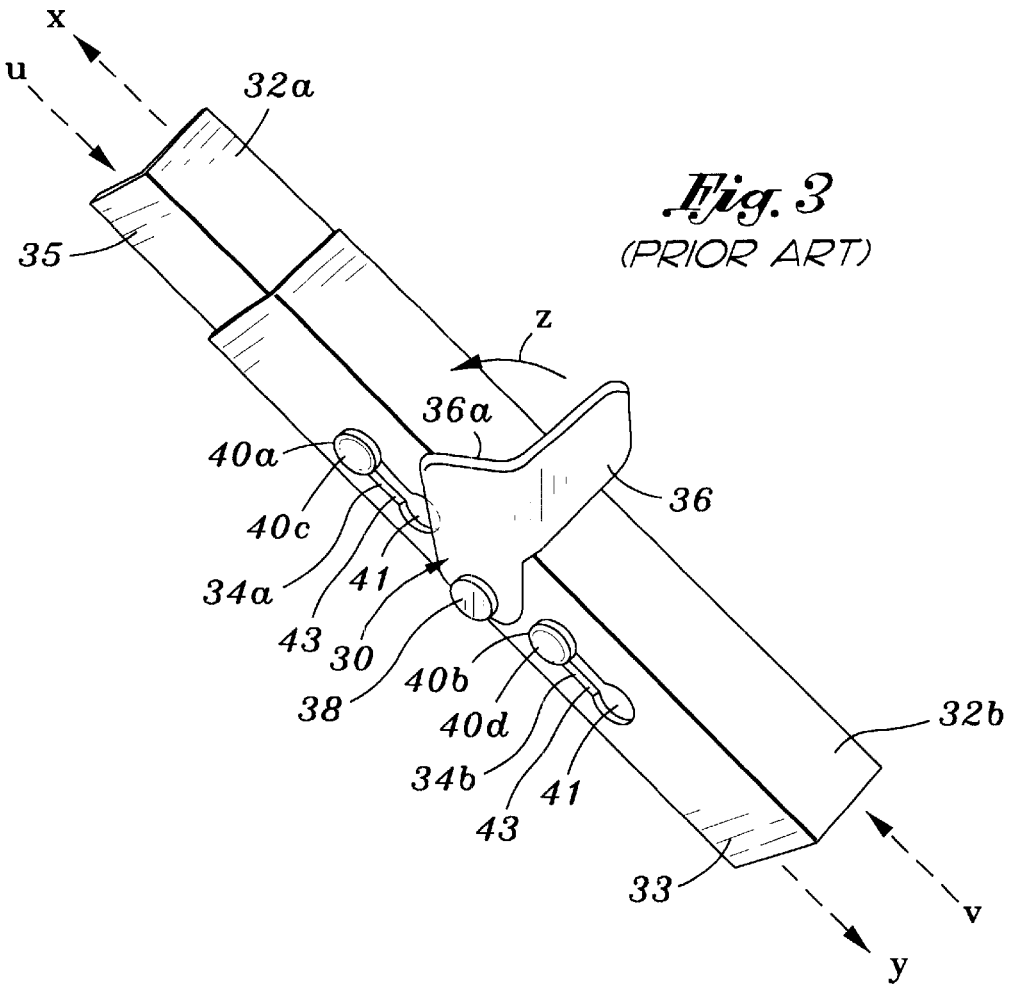
Fig. 3
(PRIOR ART)
Fig. 4
(PRIOR ART)
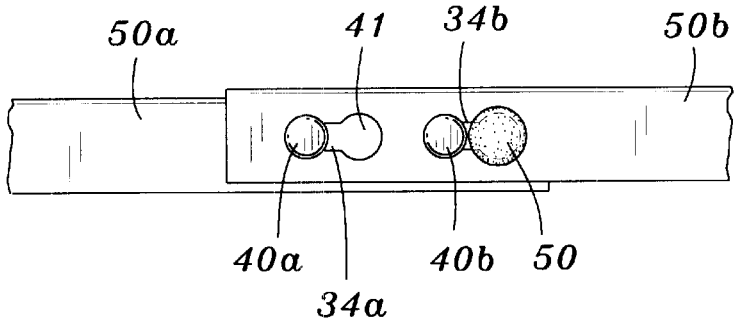

BED FRAME WITH UNIQUE CONNECTOR AND METHOD

BACKGROUND OF THE INVENTION

Bed frames are commonly used devices to support a boxspring and a mattress position on top of the boxspring. These bed frames are typically made of steel angle irons that are welded or connected together by various types of connecting devices. A typical connecting device is disclosed in U.S. Pat. No. 5,161,268, where the cross bars of a bed frame have their ends attached by a lever device that detachably holds the cross bars in the desired physical arrangement.

SUMMARY OF THE INVENTION

This invention has several features, no single one of which is solely responsible for its desirable attributes. Without limiting the scope of this invention as expressed by the claims that follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include, but are not limited to, a low cost, easy to manufacture, and convenient connector system for beds frames.

The first feature of the support frame of this invention is that it uses the weight of the boxspring it is supporting to maintain in an attached condition segments of cross bars for the frame. Specifically, the bed frame includes first and second parallel side rails. Preferably, each side rail has an L-shaped configuration and each has attached thereto spaced apart first and second cross bar segments. The side rails are adapted to be coupled together by connecting their respective aligned cross bars segments together by laterally moving the cross bars together with respect to each other. The boxspring has a predetermined width and the cross bar segments, upon assembly, have a predetermined length that is substantially equal to the width of the boxspring.

The second feature is that each cross bar segment on each side rail has an inner end connected to this one side rail and an outer end. The outer ends of the first and second cross bar segments of the first side rail are adapted to be attached to the outer ends of the first and second cross bar segments of the second side rail upon alignment of these segments. The cross bars segments extend outward from the side rails at a right angle and are positioned opposed each other and aligned so that, when these outer ends are connected together, the support frame is formed. Preferably, the inner ends of the cross bars are pivotally connected to the side rail to which they are attached. Each cross bar segment has near its outer end a connection section. One connection section of one of the aligned and opposed cross bars overlies the connection section of the other cross bar segment to which it is connected.

The third feature is that a locking element is formed in one connection section and extends inward from this connection section and is positioned at a predetermined location to be received in a receptacle in the outer end of the cross bar segment to which it is opposed and connected when said cross bar segments are attached to each other. Consequently, upon placing the boxspring on the assembled support frame, the boxspring bears down on the locking element to tend to maintain this locking element in the receptacle. The locking element and the receptacle in which the locking element is received have substantially the same shape and size. Thus, when the locking element and receptacle are aligned and positioned to be coupled, the locking element fits snugly in the receptacle and is wedged in position. Preferably, each receptacle is a hole in one of the connection sections. In the preferred embodiment, the locking element overlies the receptacle and projects inwards towards the receptacle at an angle of from about 30 to about 60 degrees. This preferred locking element has a ramp surface. The locking element faces in a direction so that the ramp surface facilitates disconnection of the cross bar segments when the segments are moved towards each other. Moreover, the locking element preferably has spring action and goes into compression during connection of the cross bar segments when the segments are moved away from each other.

The forth feature is that one of the cross bar segments has at least one connector member extending from a side wall and the other cross bar segment to which said one cross bar segment is connected has a slot, typically key shaped, in a side wall that receives the connector member when the cross bar segments are connected. Preferably, the cross bar segments have an L-shaped configuration, with one leg of the L-shaped structure forming a top wall and the other leg of the L-shaped structure forming the side wall of a predetermined thickness. The connector member in the one cross bar segment has an enlarged head and a coupling member extending into and through the slot in the side wall of the other cross bar. This enables the connector member to move reciprocally in the slot between a connection position in a restricted portion of the slot and a disconnect position in an enlarged portion of the slot. The coupling member has a length substantially equal to the thickness of the side wall through which it extends, and the slot is positioned so that, during connection, the underside of the top wall of the overlying segment is pulled tightly against the upper side of the underlying segment. This causes the locking element to go into compression. When in registration with the receptacle, the locking element is forced into the receptacle by the spring action of this locking element. In the connection position, the restricted open portion of the slot is of a size that prevents the enlarged head from passing there through, and in the disconnect position, the enlarged open portion of the slot is of a size that enables the enlarged head to pass there through.

The fifth feature is that each cross bar segment has in its top wall near its outer end a connection section made of a malleable material. The locking element and the receptacle are formed by punch pressing in the malleable material in their respective connection sections.

This invention also includes a method of supporting on a support frame a boxspring with a predetermined width, including (a) providing a support frame for the boxspring including a pair of side rails adapted to be attached together by at least one pair of cross bars, each cross bar having two segments that have outer ends, said two segments being adapted to be aligned with their outer ends placed into an overlapping and abutting relationship, the outer end of one of the two segments, with an inwardly extending locking element formed in said outer end of said one segment, and the outer end of the other aligned segment having a receptacle therein, said locking element being at a predetermined location to be received in the receptacle in the outer end of the other segment so that the distance between the attached side rails is substantially equal to the width of the box spring, (b) manually moving the two segments of each pair of cross bars into an overlapping relationship, (c) positioning said locking element in one section into the receptacle in the aligned opposed segment, and (d) placing the boxspring on the bed support between the side rails, with the boxspring bearing down on the locking element to tend to maintain said locking element in said receptacle.

DESCRIPTION OF THE DRAWING

The preferred embodiments of this invention, illustrating all its features, will now be discussed in detail. These embodiments depict the novel and non-obvious support frame of this invention and method for supporting on a support frame a boxspring as shown in the accompanying drawing, which is for illustrative purposes only. This drawing includes the following figures (Figs.), with like numerals indicating like parts:

FIG. 3 is a perspective view of the connecting device for bed frames disclosed in U.S. Pat. No. 5,161,268.

FIG. 4 is a side elevational view of a third type of prior art device used to connect together the crossbars of a bed frame.

DESCRIPTION OF THE PRIOR ART

Figure 1:
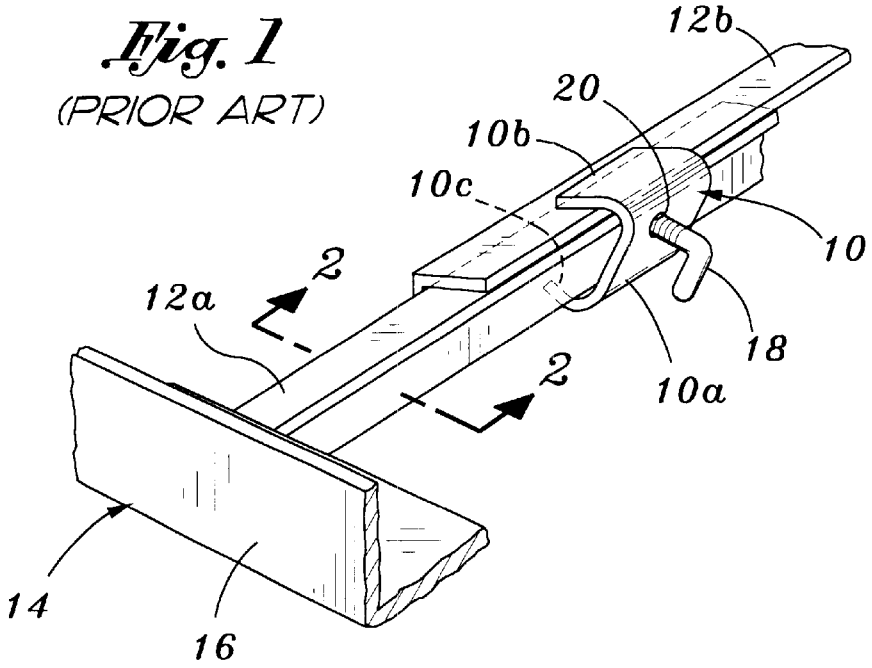
Fig. 1 (PRIOR ART)
FIG. 1 is a perspective view of one type of prior art device used to connect together the cross bars of a bed frame.
Figure 2:
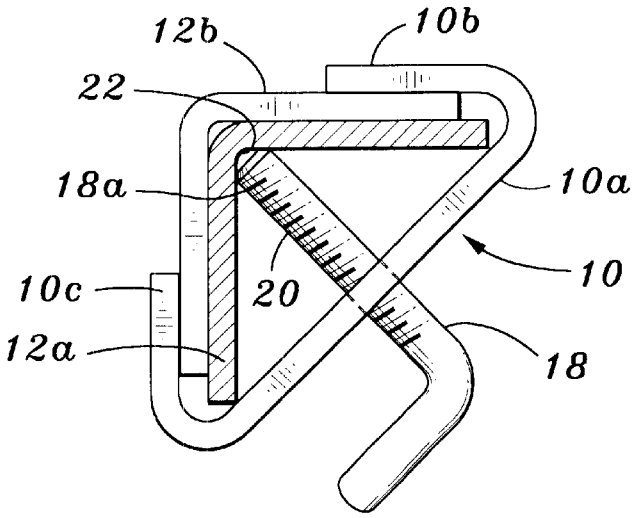
Fig. 2 (PRIOR ART)
FIG. 2 is a cross-sectional view taken along line 2—2 of FIG. 1.

As shown in FIGS. 1 and 2, a conventional clamp 10 holds together a pair of opposed cross bar segments 12*a* and 12*b* of a bed frame 14. Each cross bar segment 12*a* and 12*b* extends outward at a right angle from a pair of parallel side rails 16 (only one shown) of the bed frame 14. The ends of these cross bars segments 12*a* and 12*b* are first aligned and brought into an overlapping and abutting relationship. The clamp 10 is then slid over the assembled overlapping and abutting ends of the segments 12*a* and 12*b*. The clamp 10 has a center plate 10*a* from which extend two inwardly bent fingers 10*b* and 10*c*. These fingers 10*b* and 10*c* fit snugly around the assembled ends of two aligned cross bar 14 segments 12*a* and 12*b*. An L-shaped screw 18 extends through an opening 20 in the center plate 10*a* and has its distal end 18*a* aligned with the bite 22 of the overlapping ends of the cross bar segments 12*a* and 12*b*. The screw 18 is turned until it firmly presses against the bite 22 and the fingers 10*b* and 10*c* of the clamp 10 firmly grasp the overlapping ends of the cross bars 12 and 12*b*. To disassemble the cross bar segments 12*a* and 12*b*, the screw is loosened and the clamp 10 is removed.

FIG. 3 illustrates the Lev-R-Lock connector 30 sold by Hollywood Bed & Spring Manufacturing Company, Inc. and disclosed in detail in U.S. Pat. No. 5,161.268. With this connector 30, a pair of opposed cross bar segments 32*a* and 32*b* are first aligned and brought into an overlapping and abutting relationship. The upper cross bar segment 32*b* has a pair of key shaped slots 34*a* and 34*b* in its side wall 33 and a lever 36 mounted to the side wall 33 by a rivet 38 to pivot between a locked position and an unlocked position as shown in solid lines. There are a pair of spaced apart rivets 40*a* and 40*b*, each having enlarged heads 40*c* and 40*d*, respectively, mounted to the side wall 35 of the cross bar segment 32*a*. First, with the lever 36 is in the unlocked position as shown in FIG. 3, the heads 40*c* and 40*d* are positioned to pass through a large open area 41 of each of the key shaped slots 34*a* and 34*b*, respectively. Next, the two aligned and overlapping cross bar segments 32*a* and 32*b* are moved away from each other as indicated by the arrows x and y, with the heads 40*c* and 40*d* sliding along a narrow open area 43 of each of the key shaped slots 34*a* and 34*b* until each head abuts an end of the narrow of open area as shown in solid lines FIG. 3. With the cross bar segments 32*a* and 32*b* assembled as shown in FIG. 3, the lever 36 is pushed downward in the direction indicated by the arrow z into the locked position where the lever's forward edge 36*a* engages the rivet head 40*c*. To disassemble, the lever 36 is pulled upward into the unlocked position shown in FIG. 3 and the cross bar segments are pushed towards each other as indicated by the arrows u and v until the enlarged heads 40*c* and 40*d* are aligned with the large open areas 41 in each of the key shaped slots 34*a* and 34*b*. the cross bar segments are now separated by moving them laterally away from each other.

A third way of connecting aligned and overlapping and abutting cross bar segments 50*a* and 50*b* is depicted in FIG. 4. The cross bar segments 50*a* and 50*b* differ from those shown in FIG. 3 only in that no lever 36 is employed. The upper segment 50*b* has the key shaped slots 34*a* and 34*b* therein and the lower segment 50*a* has the rivets 40*a* and 40*b* seated in these slots in the same manner as discussed above in connection with FIG. 3. In place of the lever 36, a plug 50 is inserted into the large open area 41 in the key shaped slot 34*b*. This plug 50 is removed to disassemble the cross bar segments 50*a* and 50*b*, and because it typically is made of plastic, is deformed upon removal and cannot be reused.

DESCRIPTION OF THE PREFERRED EMBODIMENT

Figure 5:
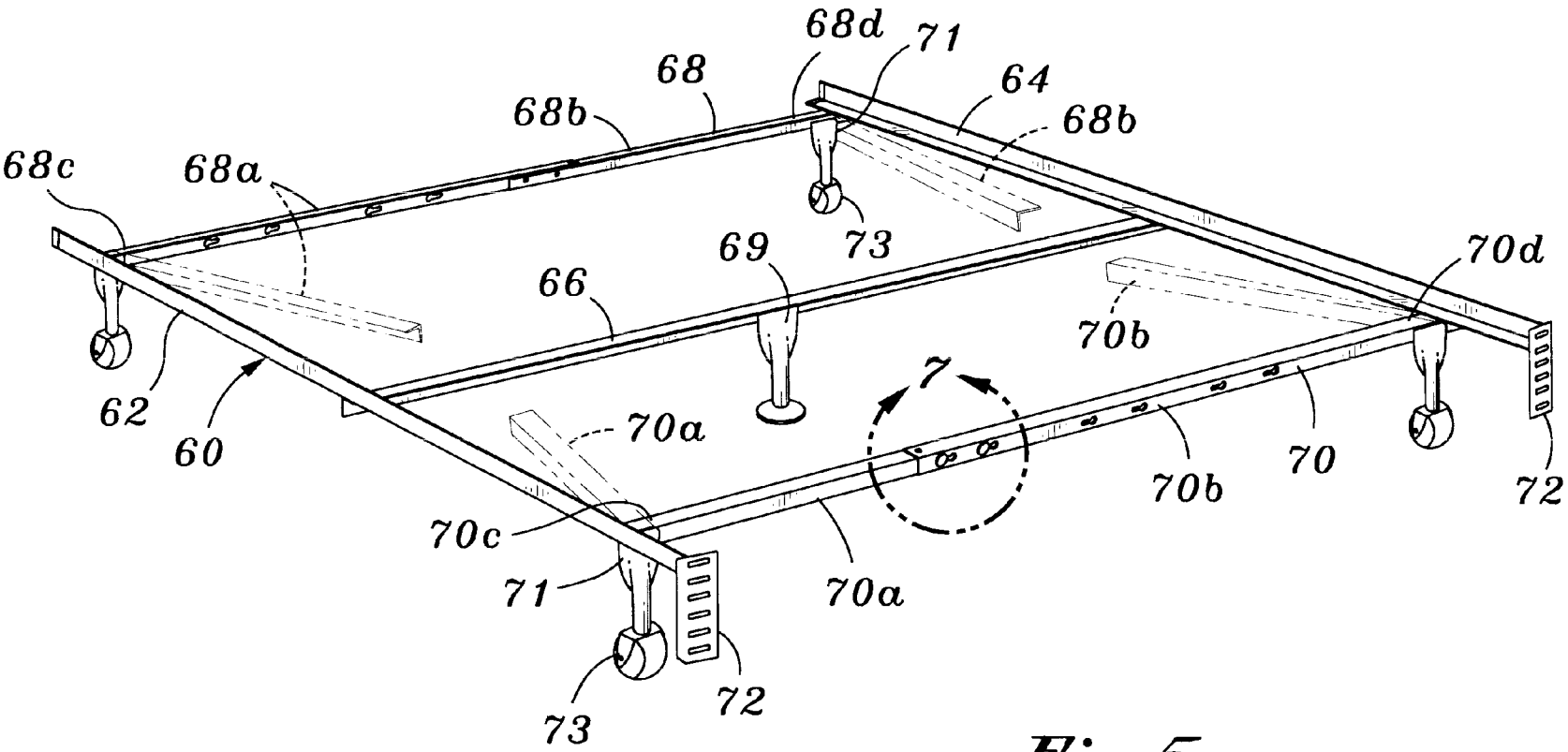
FIG. 5 is a perspective view of a bed frame made in accordance with this invention

As depicted in FIG. 5, the bed frame 60 of this invention includes a pair of L-shaped side rails 62 and 64 that are connected together by a center bar 66 and a pair of cross bars 68 and 70. At the ends of each of the side rails 62 and 64 are headboard brackets 72. Typically, the opposed ends of the center bar 66 are bolted, or otherwise connected, to the central portions of the side rails 62 and 64 and a leg 69 extends downward from the middle of the center bar to rest on a floor (not shown). At each corner of the bed frame 60 are legs 71 with casters 73 that rest on the floor.

Each cross bar 68 and 70 consists of a pair of L-shaped cross bar segments 68*a* and 68*b* and 70*a* and 70*b*, respectively. The inner ends 68*c* and 68*d* and 70*c* and 70*d* of each of the cross bar segments 68*a*, 68*b*, 70*a* and 70*b* are connected to a corresponding side rail 62 or 64 as the case may be. Preferably, each of the cross bar segments 68*a*, 68*b*, 70*a* and 70*b* are pivotally attached to a side rail. This enables the cross bar segments to be folded inwardly up against their respective side rails during storage and shipment as shown in dotted lines. During assembly, the crossbar segments 68*a*, 68*b*, 70*a* and 70*b* are moved outwardly at a right angle with respect to the side rail to which they are attached. The two side rails 62 and 64 are then positioned opposite each other and in parallel, and each pair of cross bar segments 68*a* and 68*b*, and 70*a* and 70*b*, are aligned and brought into and overlapping and abutting relationship. The precise manner in which this is accomplished is discussed in detail with respect to the cross bar segments 70*a* and 70*b* in connection with FIGS. 5 and 6. The cross bar segments 68*a* and 68*b* are attached and detached in the same manner as the cross bar segments 70*a* and 70*b*.

Figure 6:
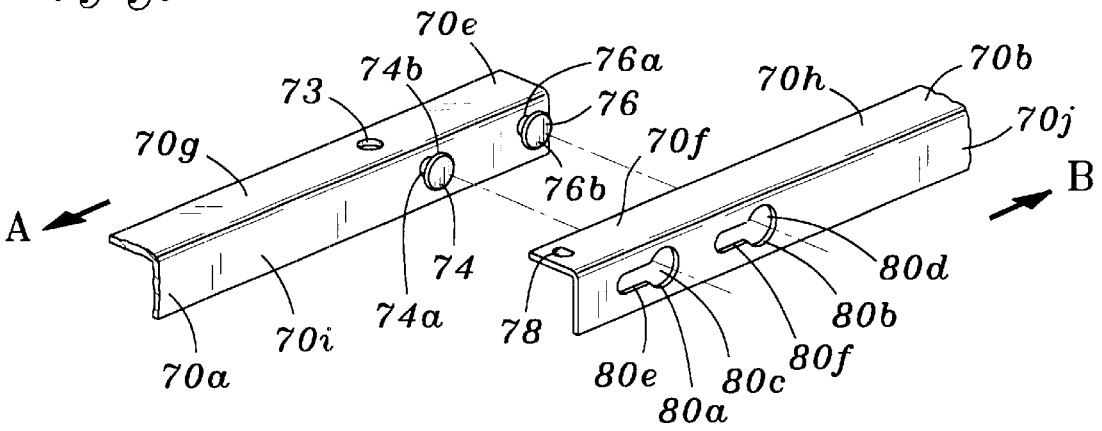
FIG. 6 is an exploded perspective view showing opposed ends of one pair of cross bars segments aligned to be brought together in an overlapping and abutting position as shown in FIG. 7.
Figure 7:
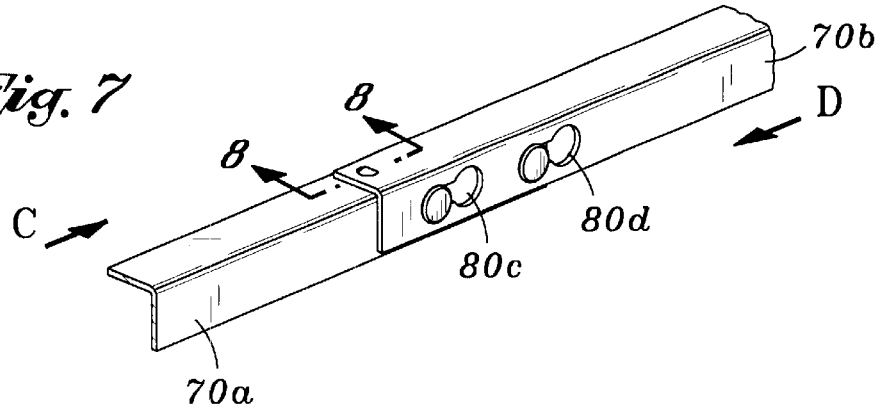
FIG. 7 is an enlarged perspective view of the connected ends of the pair of cross bar segments shown in FIG. 6 and encircled by the line 7 in FIG. 5.
Figure 8:
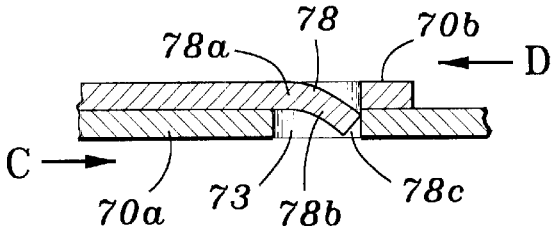
FIG. 8 is a cross-sectional view taken along line 8—8 of FIG. 7.

Referring to FIGS. 6 through 8, the outer ends 70*e* and 70*f*, respectively of the cross bar segments 70*a* and 70*b*, each constitute a connecting section made of a malleable material, preferably a metal such as, for example, steel. Each cross bar segment 70*a* and 70*b* has an L-shaped cross section with top walls 70*g* and 70*h*, respectively, adjoined at right angles, respectively, to side walls 70*i* and 70*j*. The outer end 70*e* of the top wall 70*g* of the cross bar segment 70*a* has therein a punched out hole 73, preferably in the form of a circle, but other geometric shapes may also be used. In the side wall 70*i* of this inner end 70*e* are a pair of spaced-apart rivets 74 and 76 that serve as connector members similar to the rivets 40*a* and 40*b* used in the prior art. Each rivet 74 and 76 has a coupling section or leg 74*a* and 76*a*, respectively, which is at a right angle to the side wall 70*i*. Each rivet 74 and 76 terminates in an enlarged circular head 74*b* and 76*b*, respectively.

The inner end 70*f* of the cross bar segment 70*b* has therein a locking element 78. This locking element 78 is formed by partially punching out a semi-circular section in the top wall 70*h* of the cross bar segment 70*b*. This semi-circular locking element 78 has a portion 78*a* (FIG. 8) that remains integral with the top wall 70*h*. The bulk of the semi-circular locking element 78 projects inward and faces in a direction that facilitates disconnection of the segments 70*a* and 70*b*when they are moved towards each other as shown in FIG. 8. The underside of the locking element 78 provides a ramp surface 78*b*.

There is in the side wall 70*j* of this crossbar segment 70*b* a pair of aligned key hole slots 80*a* and 80*b* similar to the slots 41 used in the prior art. Each slot 80*a* and 80*b* has an enlarged opening 80*c* and 80*d*, respectively, that merges with a narrow opening 80*e* and 80*f*, respectively. The thickness of the side wall 70*j* of this crossbar 70*b* is approximately equal to the length of the coupling members 74*a* and 76*a* of the rivets 74 and 76. Thus, as best shown in FIGS. 6 and 7, when the ends 70*e* and 70*f* of the cross bar segments 70*a* and 70*b* are brought into an overlapping and abutting relationship and the rivet heads 74*b* and 76*b* are in registration with the enlarged openings 80*c* and 80*d*, the enlarged heads 74*b* and 76*b* pass through these enlarged openings and hold the side walls and top walls of the two segments 70*a* and 70*b* snugly together.

The cross bar segments 70*a* and 70*b* are coupled together after the rivets heads 74*b* and 76*b* are placed in the enlarged openings 80*c* and 80*d*. The hole 73 serves as a receptacle for the locking element 78 upon moving the cross bar segments 70*a* and 70*b* away from each other as indicated by the arrows A and B in FIG. 6. This relative movement of the cross bar segments 70*a* and 70 moves the coupling members 74*a* and 76*a* into the restricted openings 80*e* and 80*f* so that the enlarged heads 74*b* and 76*b* cover these restricted openings as shown in FIG. 7. This also brings the locking element 78 into alignment with the hole 73. As the cross bar segments 70*a* and 70*b* move relative to each other, the tip 78*c* of the ramp surface 78*b* rides over the top 70*g* of the cross bar segment 70*a*, and is bent slightly to compress the locking element 78. When the locking element 78 is in registration with the hole 73, the spring action of the locking element assists in forcing the locking element into the hole. The diameter of the locking element 78 is about the same as the diameter of the hole 73, so consequently, the locking element is wedged into the hole. The hole 73 is located precisely, so that when the cross bar segments 70*a* and 70*b* are properly positioned with the rivets located as shown in FIG. 7, the locking element 78 securely locks the cross bar segments together. When a boxspring is placed on the assembled bed frame 10, the weight of the boxspring bears down on the locking element seated in the hole 73 to assist in maintaining the locking element in the hole.

To disassemble the side rails 62 and 64, the cross bar segments 68*a* and 68*b* and 70*a* and 70*b* are disconnected. Again with reference to the cross bars segments 70*a* and 70*b*, this is accomplished by first moving these segments towards each other in the directions shown by the arrows C and D, bringing the enlarged heads 74*b* and 76*b* to a position opposite the enlarged opening 80*c* and 80*d* in the slots 80*a* and 80*b*. Because of the ramp surface 78*b* provided by the underside of the locking element 78, the locking element slides easily from the hole 73. The locking element 78 faces in a direction so that the ramp surface 78*b* facilitates disconnection of the cross bar segments 70*a* and 70*b* when these segments are moved towards each other. In other words, when the segments 70*a* and 70*b* are moved in the direction of the arrows C and D, the tip 78*c* moves from the hole 73. This relative movement of the segments 70*a* and 70*b* causes the ramp surface 78*b* the slide over the top 70*g* of the segment 70*a* withdrawing the tip 78*c* from the hole 73. Next, the cross bar segments 70*a* and 70*b* are separated by pulling the rivets 74 and 76 from the key hole slots 80*a* and 80*b*, with the enlarged heads 74*b* and 76*b* passing through the enlarged openings 80*c* and 80*d*.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A support frame for a boxspring, including first and second of side rails, each side rail having attached thereto spaced apart first and second cross bar segments, with each cross bar segment on each side rail having an inner end connected to the side rail and an outer end, the outer ends of the first and second cross bar segments of the first side rail being adapted to be attached to the outer ends of the first and second cross bar segments of the second side rail upon alignment of said segments, said side rails being adapted to be coupled together by connecting their respective aligned cross bars segments together by laterally moving the cross bars together with respect to each other, so that said rails are parallel to each other and spaced apart, with the cross bars segments extending outward from the side rails at a right angle and positioned opposed each other and aligned and connected together at their respective outer ends to form the support frame, each cross bar segment having near its outer end a connection section, one connection section of one of the aligned and opposed cross bars overlying the connection section of the other cross bar segment to which it is connected, a locking element formed in one connection section and extending inward from said connection section and positioned at a predetermined location to be received in a receptacle in the outer end of the one opposed cross bar segment to which it is connected when said cross bar segments are attached to each other, said locking element and the receptacle in which the locking element is received each having substantially the same shape and size, and, when the locking element and receptacle are aligned and positioned to be coupled together, the locking element fits snugly in the receptacle and is wedged in position, projecting inwardly into the receptacle at an angle of from 30 to 60 degrees, whereby, upon placing the boxspring on the assembled support frame, said boxspring bearing down on the locking element to tend to maintain said locking element in said receptacle.

2. The support rail of claim 1 where the locking element and the receptacle in which the locking element is received having substantially the same shape and size, and, when the locking element and receptacle are aligned and positioned to be coupled together, the locking element fitting snugly in the receptacle and being wedged in position.

3. The support rail of claim 1 where each receptacle is a hole in one of the connection sections.

4. The support rail of claim 1 where the cross bars have an L-shaped configuration and the side rails have an L-shaped configuration.

5. The support rail of claim 1 where one of the cross bar segments has at least one connector member extending from a side wall and the other cross bar segment to which said one cross bar segment is connected has a slot in a side wall that receives the connector member of the one cross bar segment when the cross bar segments are connected.

6. The support rail of claim 5 where the side walls each have a predetermined thickness and the connector member in the one cross bar segments has an enlarged head and a coupling member extending into and through the slot in the side wall of the other cross bar to enable the connector member to move reciprocally in the slot between a connection position and a disconnect position, said coupling member having a length substantially equal to the thickness of the side wall through which it extends, in the connection position the slot having a restricted opening of a size that prevents the enlarged head from passing there through and in the disconnect position the slot having an enlarged opening of a size that enables the enlarged head to pass there through.

7. The support rail of claim 1 where the boxspring has a predetermined width and the cross bar segments upon assembly have a predetermined length that is substantially equal to the width of the boxspring.

8. The support rail of claim 1 where the inner ends of the cross bars are pivotally connected to the side rail to which they are attached.

9. A support frame for a boxspring, including first and second of side rails, each side rail having attached thereto spaced apart first and second cross bar segments, with each cross bar segment on each side rail having an inner end connected to the side rail and an outer end, the outer ends of the first and second cross bar segments of the first side rail being adapted to be attached to the outer ends of the first and second cross bar segments of the second side rail upon alignment of said segments, said side rails being adapted to be coupled together by connecting their respective aligned cross bars segments together by laterally moving the cross bars together with respect to each other, so that said rails are parallel to each other and spaced apart, with the cross bars segments extending outward from the side rails at a right angle and positioned opposed each other and aligned and connected together at their respective outer ends to form the support frame, each cross bar segment having near its outer end a connection section, one connection section of one of the aligned and opposed cross bars overlying the connection section of the other cross bar segment to which it is connected, a locking element formed in one connection section and extending inward from said connection section and positioned at a predetermined location to be received in a receptacle in the outer end of the one opposed cross bar segment to which it is connected when said cross bar segments are attached to each other, whereby, upon placing the boxspring on the assembled support frame, said boxspring bearing down on the locking element to tend to maintain said locking element in said receptacle, and where the locking element overlies the receptacle and projects inwards towards the receptacle at an angle of from 30 to 60 degrees.

10. The support rail of claim 9 where the locking element has a ramp surface and faces in a direction so that the ramp surface facilitates disconnection of the cross bar segments when the segments are moved towards each other.

11. The support rail of claim 10 where the locking element has spring action and goes into compression during connection of the cross bar segments when the segments are moved away from each other.

12. A support frame for a boxspring, including first and second of side rails, each side rail having attached thereto spaced apart first and second L-shaped cross bar segments, with each cross bar segment having a top wall and a side wall disposed at a right angle to the top wall, an inner end connected to the side rail to which it is attached and an outer end, the outer ends of the cross bars being adapted to be attached to each other, said side rails being adapted to be coupled together so that said rails are parallel to each other and spaced apart by connecting their respective cross bar segments together by laterally moving the cross bar segments together with respect to each other, said cross bar segments extending outward from the side rails at a right angle and positioned opposite each other and aligned and connected together at their respective outer ends to form the support frame, with the top wall of one cross bar overlying and abutting the top wall of the other cross bar and the side walls of each aligned and connected cross bars abutting each other, each cross bar segment having in its top wall near its outer end a connection section made of a malleable material, with one connection section of one of the aligned and opposed cross bars segments overlying the connection section of the other cross bar segment to which it is connected, and one connection section of one cross bar segment having a locking element and the other connection section of the other cross bar segment having a receptacle into which is received the locking element, said locking element and said receptacle being formed by punch pressing in the malleable material in their respective connection sections, the locking element and the receptacle in which the locking element is received having substantially the same shape and size and, when the locking element and receptacle are aligned, the locking element fitting snugly in the receptacle and being wedged in position to project inwardly into the receptacle at an angle of from 30 to 60 degrees, and one of the cross bar segments having a connector member extending from its side wall and the other cross bar to which said one cross bar segment is connected having a slot in its side wall that receives the connector member of said one cross bar segment when the cross bar segments are connected.

13. The support rail of claim 12 where the side walls each have a predetermined thickness and the connector member in the one cross bar segment has an enlarged head and a coupling member extending into and through the slot in the side wall of the other cross bar segment to enable the connector member to move reciprocally in the slot between a connection position and a disconnect position, said coupling member having a length substantially equal to the thickness of the side wall through which it extends, in the connection position the slot having a restricted opening of a size that prevents the enlarged head from passing there through and in the disconnect position the slot having an enlarged opening of a size that enables the enlarged head to pass there through.

14. In combination, a boxspring having a predetermined width, a support frame for the boxspring including a pair of side rails attached together by at least one pair of cross bars, each cross bar having two segments with outer ends that overlap, and the outer end of one of the two segments having an inwardly extending locking element formed in said outer end, and the outer end of the other segment having a receptacle therein, with the two segments of each pair of cross bars in a overlapping and abutting relationship, said locking elements being positioned at a predetermined location to be received in the receptacle in the outer end of the other segment so that the distance between the attached side rails is substantially equal to the width of the box spring, the locking elements and the receptacles in which the locking elements are received having substantially the same shape and size and, when each locking element and receptacle are aligned, the locking element fits snugly in the receptacle and is wedged in position to project inwardly into the receptacle at an angle of from 30 to 60 degrees, and one outer end of one cross bar segment having at least one connector member extending therefrom and the other outer end to which said one segment is connected having a slot therein that receives the connector member of said one segment when the segments are connected together.

15. A support frame for a boxspring including a pair of side rails attached together by at least one pair of cross bars that are moved away from each other during attachment of these segments and moved towards each during disconnection of these segments, each cross bar comprising two L-shaped segments with outer ends that overlap and are in an abutting relationship, said outer ends being made of a malleable material with the outer end of one of the two segments having a locking element formed by punch pressing in the malleable material and the outer end of the other segment having a receptacle therein formed by punch pressing in the malleable material, said locking element (a) overlying the receptacle and projecting inward towards said receptacle at an angle of from 30 to 60 degrees and (b) having a ramp surface facing in a direction so that the ramp surface facilitates disconnection of the cross bar segments when the segments are moved towards each other and going into compression during connection of the cross bar segments when the segments are moved away from each other, said locking elements on each cross bar being positioned at a predetermined location to be received in the receptacles in the outer end of the other segment so that the distance between the attached side rails is substantially equal to the width of the box spring and one outer end of one cross bar segment having at least one connector member extending therefrom and the other outer end to which said one segment is connected having a slot therein that receives the connector member of said one segment when the segments are connected together.

* * * * *